United States Patent [19]

Tschirky et al.

[11] 3,989,114

[45] Nov. 2, 1976

[54] CIRCULATION SUB FOR IN-HOLE HYDRAULIC MOTORS

[75] Inventors: John E. Tschirky, Long Beach; Gary M. Crase, Cypress, both of Calif.

[73] Assignee: Smith International, Inc., Newport Beach, Calif.

[22] Filed: Mar. 17, 1975

[21] Appl. No.: 559,035

[52] U.S. Cl. ..... 175/107; 175/317

[51] Int. Cl.[2] ..... E21B 3/12

[58] Field of Search ..... 175/107, 104, 92, 231, 175/317, 318, 234, 235, 243, 232, 61

[56] References Cited

UNITED STATES PATENTS

| | | | |
|---|---|---|---|
| 2,312,789 | 3/1943 | Appleby | 175/317 X |
| 2,596,832 | 5/1952 | Williams | 175/318 X |
| 2,865,602 | 12/1958 | Whittle | 175/232 X |
| 2,882,020 | 4/1959 | Carr et al. | 175/317 X |
| 3,211,244 | 10/1965 | Cordary | 175/231 X |
| 3,661,218 | 5/1972 | Brown | 175/107 |
| 3,799,278 | 3/1974 | Oliver | 175/237 |
| 3,802,521 | 4/1974 | Oliver | 175/318 |
| 3,857,655 | 12/1974 | Tschirky | 175/107 X |

FOREIGN PATENTS OR APPLICATIONS

| | | | |
|---|---|---|---|
| 762,749 | 12/1956 | United Kingdom | 175/107 |

*Primary Examiner*—James A. Leppink
*Assistant Examiner*—Richard E. Favreau
*Attorney, Agent, or Firm*—Philip Subkow; Bernard Kriegel

[57] ABSTRACT

This invention relates to circulation subs used in connection with hydraulic in-hole motors with means for selectively interrupting circulation through the circulation sub.

7 Claims, 6 Drawing Figures

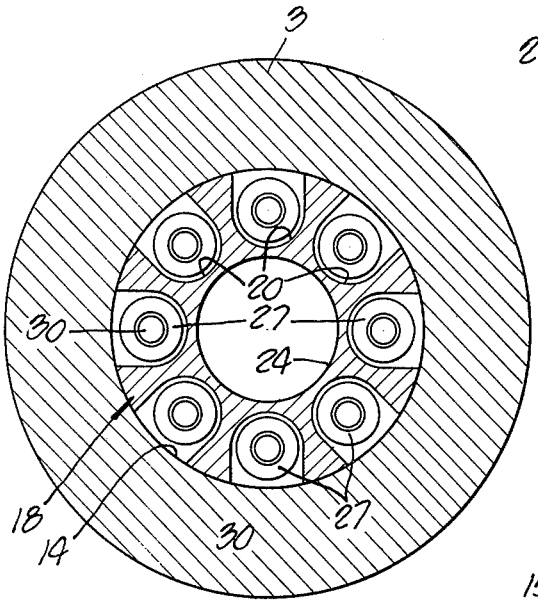
FIG. 3.
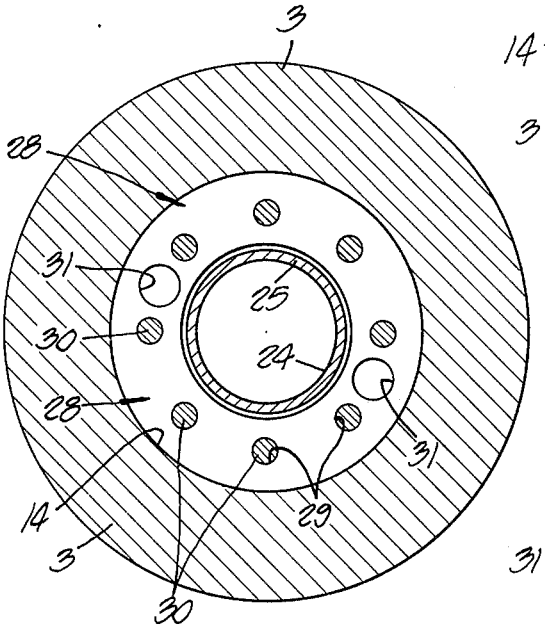
FIG. 4.
FIG. 6.
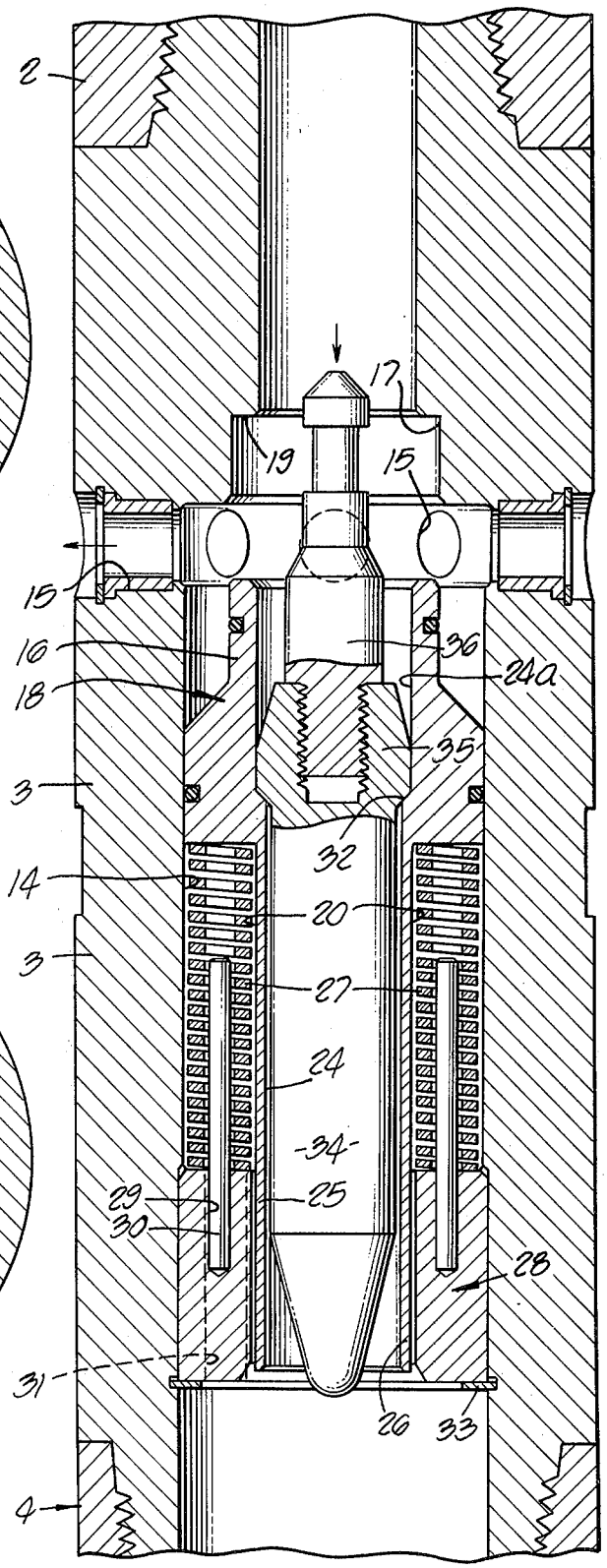

CIRCULATION SUB FOR IN-HOLE HYDRAULIC MOTORS

This invention relates to in-hole, bore-hole drilling equipment and method employing a circulating fluid for removal of cuttings. The invention is useful in drilling bore holes for production of oil, water, or gas, or in mining.

In its preferred embodiment, the invention is applied to in-hole motors operating at the end of a drill string, in which fluid circulation for removal of cuttings is employed. It may be applied to hydraulic or pneumatic motors or to electrical motors. The hydraulic motors may be progressive cavity motors, such as are described in U.S. Pat. No. 3,857,655 issued Dec. 31, 1974, incorporated herein by this reference, or the so-called turbine-type motor known as the turbodrill.

The particular improvement of this invention means, when the motor is not called upon to apply a useful torque to the drill bit, as when the drill is off bottom, whereby the circulating fluid is by passed so as not to pass through the motor.

In the case of in-hole motors, situations do occur when the in-hole motor and the drill bit are off bottom but where circulation of the drilling fluid is required. Such cases occur where in such circumstances materials, such as a mud cake, are to be built up on the wall of the hole or where pressure has to be maintained on the formation to avoid blowout or collapsing of the hole or where removal of the cuttings is desired. These circumstances are well known to those skilled in the art.

When drilling is discontinued, the usual purpose is to come out of the hole in order to change the drill bit or to clean a plugged bit. In such case, it is necessary to circulation to remove the cuttings contained in the annulus in order that they do not settle in the annulus and seize the drilling string. It is conventional in those circumstances to continue circulation until the mud is clear of cuttings before starting the removal of the string. Another purpose for continued circulation is to be sure that the mud cake on the wall is maintained.

Bypass devices have been used in the prior art for other uses, such as in well cementing (see Hayward U.S. Pat. No. 2,379,079). Other uses are shown in Clark U.S. Pat. No. 3,005,507. A further use of a bypass valve is shown in Ioanesyan et al. U.S. Pat. No. 3,356,338.

The use of a bypass to circulate the drilling fluid so as to raise the cuttings in the annulus, when used in conjunction with an in-hole motor, so that the motor remains inoperative while circulation is continued, has significant novel utility.

Avoiding rotation of the motor while continuing circulation minimizes wear and tear on the rotor and stator of the motor, couplings, drive shaft, radial and thrust bearings.

The bypass reduces the pressure required to be generated by the pumps at the surface by avoiding the pressure drop across the motor and the bit. This is particularly true in hydraulic motors where the rotation of the rotor by the passage of fluid through the stator and through the bit nozzles adds a significant demand on the horsepower output of the pumps.

It has been suggested to employ such circulation subs with turbodrills by providing a bypass orifice in the drill string above the turbodrill closed by a sleeve held in position by a shear pin. In order to open the bypass, a ball is inserted in the drill string and pumped down the string. The ball is of a diameter sufficient to close the tubular sleeve, and the pump pressure acting against the ball forces the sleeve downward, shearing the pin and thus opening the bypass. (See Powell "Turbodrill Assemblies for Deviation Control in the North Sea," Petroleum Engineer, September 1973, pp. 47 and 48.)

With such devices, after circulation the string must be retrieved and broken so as to retrieve the ball and replace the shear pin before drilling can continue. In the case where the bit need not be changed or cleaned, and circulation was used, the extra trip is a serious economic disadvantage. Where circulation is needed to build up the mud cake on the bore hole wall or to clear the annulus and the bottom of the hole from detritus, when the bit is still good for further drilling, such round trips are not necessary, thus avoiding economic waste and also a waste in drilling time. For example, in drilling at sea, the rig costs may be in the order of $50,000 per day. To remove a 10,000-foot string and reenter the string, i.e., one round trip may consume 4 to 5 hours.

In addition, where drill bits with small nozzles are used where progressive cavity motors are used, the combined horsepower demand for the fluid motor and the bit nozzles, on the pumps, may range from about 4 to 50 percent, depending on the dimensions of the string, the motor, and the depth of the bore hole.

Since, depending on the circumstances, the circulation may need to be continued from a few hours to many days, the saving by the use of the circulation sub in my invention in combination with the in-hole motor is a significant improvement in the drilling art.

STATEMENT OF THE INVENTION

After circulating, in order to provide for the continuation of the drilling or other in-hole operations requiring full volume of the drilling fluid, without removal of the drill string, we accomplish this function by providing retrievable means which cooperate with the circulation sub to open said sub, and means in said sub to close the sub when the retrievable means have been removed.

This invention will be further understood by reference to the drawings of which

FIG. 3 is a section taken on line 3—3 of FIG. 2;

FIG. 4 is a section on line 4—4 of FIG. 2;

FIG. 6 is a view similar to FIG. 2 showing the bypass in open position.

Figure 1:
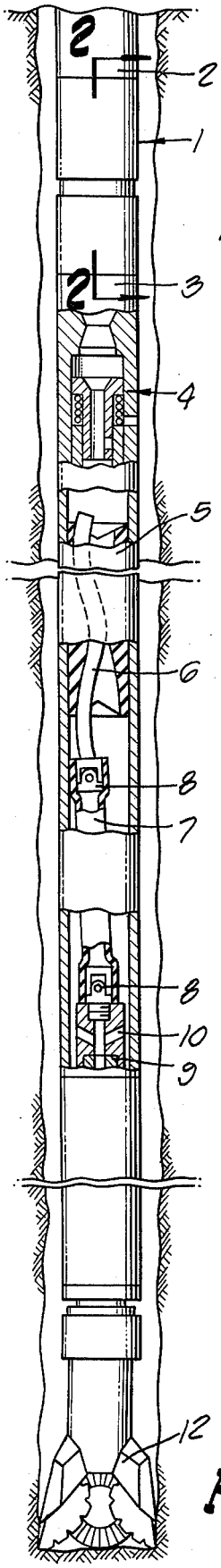
FIG. 1 is a schematic showing of the drill string to which my invention may be applied.
Figure 5:
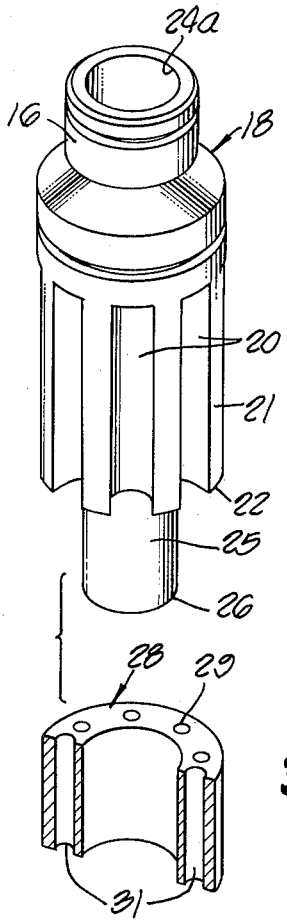
FIG. 5 shows details of the assembly shown in FIG. 2.
Figure 2:
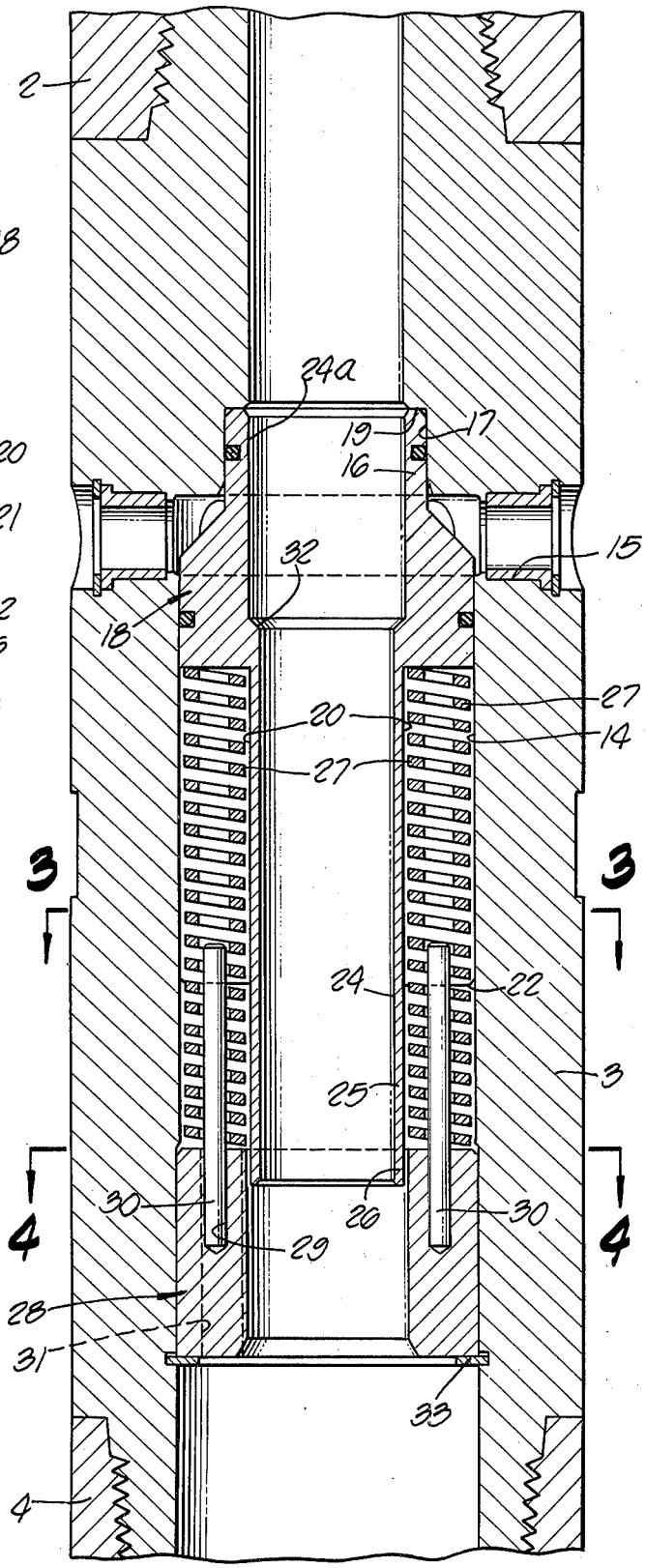
FIG. 2 is a section taken on line 2—2 of FIG. 1.

FIG. 1 shows the application of my invention in its preferred embodiment to a progressive cavity motor of the kind described in my U.S. Pat. No. 3,857,655 issued Dec. 31, 1974. The motor is assembled together with a conventional running string, comprised of drill pipe, drill collars, drill bit suspended from a swivel, hook and travelling block in a conventional drilling rig, with drilling lines passing over a crown block to a winch. Drilling fluid referred to as mud is pumped through the swivel down the drill pipe and the drill collars through the motor and the discharge nozzles in the bit and returns up the bore hole through the annulus between the running string and the wall of the bore hole to the mud pit at the surface. Such operations are conventional in the drilling art.

As is conventional in such operations, a dump valve 4 is employed which acts as a bypass which is kept closed while mud is being pumped down through the drill string and through the motor assembly and the bit. When pumping is discontinued as when the string is removed from the bore hole, the spring-loaded valve opens so that the drilling fluid in the string discharges into the bore hole.

Such a bypass known as a dump valve is conventional in the prior art in conventional drill string operations, both where ordinary rotary drilling and where in-hole motors are employed.

As shown in FIG. 1, the motor is composed of a stator 5 and a rotor 6 connected to a connecting rod 7 and a tubular drive shaft 9 by universal joints 8. The tubular drive shaft 9 operates in radial bearings and thrust bearings such as, for example, described in the above patent and is connected to a conventional bit such as a rock bit 12 or a diamond bit which carries nozzles permitting the discharge of the fluid from the hollow drive shaft through the nozzles into the annulus surrounding the drill string. The mud returns up the annulus and carries the cuttings to the surface in a conventional manner.

Positioned above the dump valve 4, if used, is a circulation sub shown in FIGS. 2–6. The housing 3 which is connected to the drill collars 2 and the drill pipe 1 has an enlarged internal diameter 14 in which is seated the valve member 18. The housing 3 is bored transversely by the ports 15 and is counterbored at 17 to form a shoulder 19. The neck portion 16 of the valve member 18 is sealed against the wall of 17 by an "O" ring. The valve member is grooved with a plurality of circumambiently disposed semicircular grooves 20 in the external surface of the depending tubular member 25. The grooves end at 22 above the end of 25. The tubular wall 25 is formed with a depending skirt 26. The valve member at its upper portion has an enlarged counterbore 24*a* forming a beveled shoulder 32. Positioned in the tubular grooves 20 are springs 27 which extend beneath the grooves 20 and abut the tubular fitting 28. The tubular fitting is formed with circumambiently positioned bores 29 which register with the semicircular grooves 20 and carry pins 30 which fit into the springs 27 and act as spring retainers. The fitting 28 carries diametrically positioned bores 31 which extend the length of the fitting 28. The fitting 28 is retained by the split retaining ring 33. The valve member is located and held in position between the ring 33 and the shoulder 19. In this position, the ports 15 are sealed from the tubular opening 24, and from the motor and the drill bit nozzles. Mud can be circulated by suitable pumps through the swivel and drill string through the dump valve, holding it in closed position as shown in FIG. 1, through the motor around the connecting rod 7, through the ports 10 in the drive shaft cap above the tubular drive shaft 9, and through the nozzles in the drill bit.

In this passage, the rotor is moved in an eccentric manner to rotate the connecting rod, shaft and the drill bit. The invention described herein permits improved circulation without rotation of the motor and the drill bit.

The drill string is raised to raise the drill bit off bottom for the purposes described above; connection with the mud pump is broken at the kelly. A mandrel 34 (see FIGS. 3–6) is introduced into the open drill string at the surface. The maximum external diameter of the mandrel is less than the internal diameter of the drill string so that it may pass freely down the string. The mandrel has an enlarged bossage 35 adapted to fit on the internal shoulder 32 closing the tube 24 when the mandrel is in place.

The kelly is reconnected, and the pump is started, pumping the mandrel down the drill string until the mandrel is seated on the beveled shoulder 32 at the upper portion of the valve member 18. The pump pressure in the drill string, due to the piston effect produced by the closure of the tube 24 by the mandrel, forces the valve member down, compressing the springs 27, as shown in FIG. 6, opening the ports 15 to the annulus. Circulation then continues through the ports 15 back to the surface through the annulus. Circulation through the motor is, therefore, interrupted. In compressing the springs, mud which is present in the semicircular grooves 20 and surrounding the depending portion of the springs is forced through the bores 31 out into the drill string below the ring 28. Interference with the displacement of the valve member by mud trapped between the grooves is prevented.

If it is desired, after suitable clearance of the cuttings by the circulation to continue drilling without coming out of the hole, the mandrel may be removed. The string is again disconnected at the kelly. A conventional overshot is lowered on a wire line to engage the spear head 36 which is screwed into the mandrel, and the mandrel is lifted out of the tubular member and returned to the surface. Such retrieving operations employing retrievable tools with overshots are conventional for many tools in the industry and will be well understood by those skilled in the art.

We claim:

1. An in-hole hydraulic motor assembly comprising a running string, including an in-hole motor, a circulation sub positioned between said running string and said motor, said circulation sub comprising a tubular housing, ports in said housing, a valve member positioned in said housing above said motor, said valve member being tubular, and springs positioned externally of said tubular valve member, spring abutting means associated with said springs, said valve member closing said ports from the interior of said tubular housing, said valve member closing said ports with the tubular opening in said valve member communicating with said tubular housing and means to open said ports and interrupt communication through said valve member.

2. In combination with the assembly of claim 1, said means to interrupt communication being a mandrel fitting in said tubular valve member and closing said tubular valve member and means on said mandrel adapted for retrieving said mandrel.

3. The assembly of claim 1, said valve member carrying grooves circumambiently positioned on the external surface of said valve member, a ring positioned in said tubular housing beneath said valve member, springs positioned on said ring and in said grooves.

4. In combination with the assembly of claim 3, said means to interrupt communication being a mandrel fitting in said tubular valve member and closing said tubular valve member and means on said mandrel adapted for retrieving said mandrel.

5. In the assembly of claim 3, bores in said ring extending the length of said ring, communicating with said grooves.

6. In combination with the assembly of claim 5, a mandrel fitting in said tubular valve member and closing said tubular member and means on said mandrel adapted for retrieving said mandrel.

7. In a drill string comprising, drill pipe, an in-hole motor and a drill bit connected to said motor and means for circulating drilling fluid through a drill string including an in-hole motor positioned in a bore hole, means to circulate drilling fluid through the drill string and through said motor and to return said drilling fluid through the annulus between the bore hole and said drill string, the improvement which comprises means to interrupt the passage of the drilling fluid through said motor and continuing the introduction of drilling fluid into the drill string, means to open a bypass for drilling fluid from said drill string into the annulus without passing through said motor, and means to close said bypass, and to pass fluid through said motor.

* * * * *